US010214393B2

(12) United States Patent
Spencer

(10) Patent No.: US 10,214,393 B2
(45) Date of Patent: Feb. 26, 2019

(54) LIFTING APPARATUS AND METHOD OF USE

(71) Applicant: Safety Products Engineering Group, Inc., Commerce City, CO (US)

(72) Inventor: Scott Spencer, Springville, UT (US)

(73) Assignee: Safety Products Engineering Group, Inc., Commerce City, CO (US)

( * ) Notice: Subject to any disclaimer, the term of this patent is extended or adjusted under 35 U.S.C. 154(b) by 0 days.

(21) Appl. No.: 15/687,481

(22) Filed: Aug. 27, 2017

(65) Prior Publication Data

US 2018/0057317 A1 Mar. 1, 2018

Related U.S. Application Data

(62) Division of application No. 14/950,368, filed on Nov. 24, 2015, now Pat. No. 9,783,393.

(51) Int. Cl.
*B66C 1/16* (2006.01)

(52) U.S. Cl.
CPC ..... *B66C 1/16* (2013.01)

(58) Field of Classification Search
CPC .. B66C 1/66; B66C 1/663; B66C 1/16; B66C 1/24; B66C 1/62; B66C 1/12; B66C 1/34; B66C 1/02; B66C 1/10; B66C 1/22; B66C 1/14; B66C 1/666; B25J 15/00; B65D 90/0033; F16G 15/08
See application file for complete search history.

(56) References Cited

U.S. PATENT DOCUMENTS

| | | | | |
|---|---|---|---|---|
| 2,006,949 | A | 7/1935 | Hockensmith | |
| 4,074,519 | A | 2/1978 | Garrett | |
| 4,195,873 | A | 4/1980 | Johnston | |
| 5,108,238 | A * | 4/1992 | Ewing | F16B 31/021 411/405 |
| 5,281,042 | A * | 1/1994 | Belrose | F16L 3/1091 248/74.4 |
| 5,286,130 | A | 2/1994 | Mueller | |
| 5,823,588 | A | 10/1998 | Morghen | |
| 5,857,390 | A * | 1/1999 | Whiteford | B25B 13/06 81/124.3 |
| 5,966,876 | A * | 10/1999 | Neathery | E02D 29/12 292/237 |
| 6,231,271 | B1 | 5/2001 | Glass et al. | |
| 8,544,923 | B2 | 10/2013 | Inda | |
| 8,544,924 | B2 | 10/2013 | Inda | |
| 2017/0144865 | A1 | 5/2017 | Spencer | |

FOREIGN PATENT DOCUMENTS

CA 2139939 * 9/1997

* cited by examiner

*Primary Examiner* — Stephen A Vu
(74) *Attorney, Agent, or Firm* — Durham Jones & Pinegar; Sarah W. Matthews; Randall B. Bateman

(57) ABSTRACT

A lifting apparatus may include a bolt assembly and a nut assembly. The bolt assembly may include a support plate, a bolt and a lifting eye attached to the support plate. The nut assembly may include a support plate, a nut and a handle attached to at least one of the support plate and the nut. A tether may also be included to connect the bolt assembly to the nut assembly.

19 Claims, 7 Drawing Sheets

LIFTING APPARATUS AND METHOD OF USE

CROSS REFERENCE TO RELATED APPLICATION

The present application is a divisional of U.S. application Ser. No. 14/950,368, filed on Nov. 24, 2015, which has been issued as U.S. Pat. No. 9,783,393, issued on Oct. 10, 2017.

BACKGROUND

1. Field of the Invention

The present invention relates to an apparatus for lifting materials. In particular, the present invention relates to an apparatus for lifting sheets of material so that they may be placed in another desired location.

2. Background of the Invention

There are a variety of situations in which a person must handle large pieces of steel or other materials and move them from one location to another. One prime example is materials which are used during construction. If a pipeline needs to be laid under a road, it is usually required to cut the road surface in order to lay the pipe. Because the road surface has been cut, the road must either be closed to traffic, or something must be placed over the opening to provide a surface over which cars and pedestrians can travel. This is often accomplished by covering the opening with a steel plate. The width of the opening will typically determine the thickness of the place. For example, in California a 1" steel plate may be used to cover an opening which is no greater than 42 inches while a 1½" plate can cover an opening up to 96 inches.

Additionally, plates can also be used to shore the sidewalls of trenches. When a trench is dug, there is a risk that the sidewalls will collapse into the void. Each year construction workers are injured and killed when the walls collapse, burying the worker. Because of this, state and federal regulatory agencies require that any trench deeper than 3 feet be properly shored. In some environments, this done by placing a frame in the trench and then inserting sheets of material between the frame and the sidewalls of the trench to prevent the trench walls from collapsing.

Regardless of the use to which the plates of material are put, handling large pieces of steel or other material can be difficult and dangerous. The plates will often weigh several hundred pounds. Thus, it is important to handle the plates properly. At the same time, it is important to have the plates of material be easy to handle to improve efficiency in placement and removal of the plates.

Figure 1:
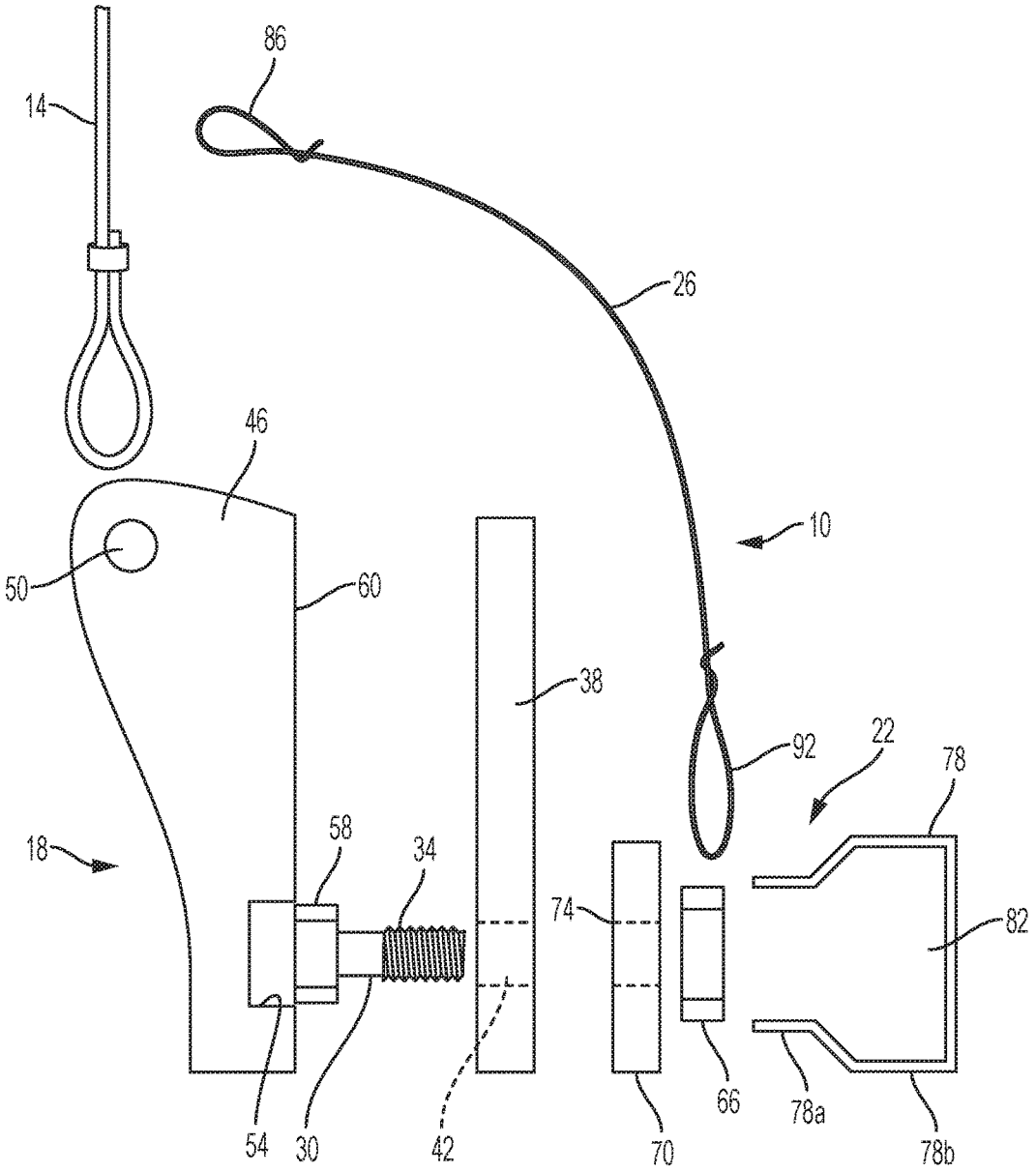
FIG. 1 shows an exploded view of a lifting apparatus in accordance with the teachings of the present disclosure.

It will be appreciated that the drawings are illustrative and not limiting of the scope of the invention which is defined by the appended claims. The embodiments shown accomplish various aspects and objects of the invention. It will be appreciated that may not be possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other or all embodiments discussed herein. Likewise, it is not required that any feature in one embodiment be included in the invention as described by the claims unless that feature is expressly mentioned in the claims.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a spring" may include an embodiment having one or more of such springs, and reference to "the layer" may include reference to one or more of such layers.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown an exploded view of a lifting apparatus, generally indicated at 10, made in accordance with principles of the present disclosure. The lifting apparatus 10, may include a lifting cable 14, a bolt assembly, generally indicated at 18, a nut assembly, generally indicated at 22 and a tether 26.

The bolt assembly 18, may include a bolt 30, which may be a shoulder bolt, a coil thread bolt, or other type of bolt. While the bolt 30 may be of various sizes, for the lifting of large metal plates it has been found that a bolt which has a threaded shaft 34 which is between ¼th and ¾ths of an inch thick works well for lifting smaller items, with ⅜ths to ½ inch being presently preferred. For larger items a bolt having a diameter of ¾ths of an inch to 1½ inches works well, with approximately 1 inch thick being preferred.

The bolt assembly 18 may also include a support plate, such as a base plate 38. While shown in the figures as being generally rectangular, the base plate 38 be any desired shape, including round, square, triangular, etc. The base plate 38 may include a hole 42 which is sized to receive the shaft 34 of the bolt 30. Then the bolt 30 is inserted into the hole 42, the base plate 38 expands the surface area for engaging a plate of material. It also provides additional surface area with which to connect the bolt 30 to a lifting eye or lifting eye 46.

The lifting eye 46 may include a hole 50 or other opening for receiving the lifting cable 14. The lifting eye 46 may also have a sidewall which defines a notch 54 or other indentation to allow for the head 58 of the bolt 30. Such a configuration allows for a sidewall 60 of the lifting eye 46 to have substantial surface area for attachment to the base plate 38. In an assembled configuration, the shaft 34 of the bolt 30 may be inserted into the hole 42 in the base plate 38 and then the lifting eye 46 welded to the support plate along the sidewall 60. The head 58 of the bolt 30 may be welded to the base plate 38 and/or the lifting eye 46 to prevent rotation of the bolt 30 within the hole.

The nut assembly 22 may include a nut 66 and a nut support or washer plate 70 having a hole 74 disposed therein for receiving the shaft 34 of the bolt 30 so that the shaft can engage the nut. While not required, it is presently preferred that the nut 66 be welded or otherwise attached to the washer plate 70. Alternatively the nut may be formed integrally in the washer plate 70.

The nut assembly 22 may also include a handle 78. The handle 78 is preferably configured so as to allow a user to tighten the bolt 66 on the shaft 34 of the bolt 30 without the need for tools and the like. To that end, the handle 78 may be formed from a longer piece of metal or cut so that one portion is configured to be welded or otherwise attached to the washer plate 70 and/or the nut 66. The nut 66 may also be welded or otherwise attached to the support plate.

As shown in FIG. 1, the handle 78 may include a first, narrow section **78*a* which is configured to attach to the nut 66 or washer plate 70, and a second, broad section 78*b* wherein the handle flares out to provide a greater length along which the handle may be grasped to thereby rotate the bolt (either directly or indirectly). Thus, in most situations, a worker can manually attach the nut assembly 22 to the bolt shaft 34 without the need for tools. The shape of the handle 78 leaves an opening 82 which allows the bolt shaft 34 to extend well beyond the end of the nut 66**.

FIG. 1 also shows the tether 26. The tether 26 is configured to engage the lifting cable 14 and/or the lifting eye 46 at or adjacent to one end, and the handle 78 of the nut assembly 22 at or adjacent an opposing end. Thus, for example, the tether 26 may include a first attachment or loop 86 and a second attachment or loop 92. (Whiles loops are shown on the tether, it will be appreciated that other forms of attachment such as clasps, hooks, carabineers and the like may be used). The first loop 86 can pass around the cable 14 or through the hole 50 in the lifting eye 46. The loop 92 at the opposing end may wrap around the handle 78. Thus the loop 92 of the tether 26 may pass through the opening 82. However, it is presently preferred the loop 92 be sized to fit around the first, narrow portion 78*a*, but be small enough that it cannot easily be pulled over the second, broader portion 78*b*. Thus, the loop 92 is essentially held between the second, broader portion and the washer plate 70.

In construction the loop 92 may be placed about the first, narrower portion 78*a* of the handle 78 prior to attachment of the handle 78 to the nut 66 and/or support plate. More commonly, however, the loop 92 will simply be formed so that it is only slightly larger than the length of the handle 78. By pressing the sides of the loop toward one another, the loop 92 can be elongated just enough to fit over the handle. Once the loop 92 is moved down to the first, narrower portion 78*a*, the loop is allowed to return to a more circular or rounded orientation wherein the handle 78 will not pull out without a reasonable amount of force. This allows the nut assembly 22 to be held to the bolt assembly 18 even after being removed from the shaft 34 of the bolt. It is common in prior art configurations for workers to lose the nut off of a lifting apparatus, rendering the apparatus unusable until the nut is found or a new nut is obtained.

Figure 2:
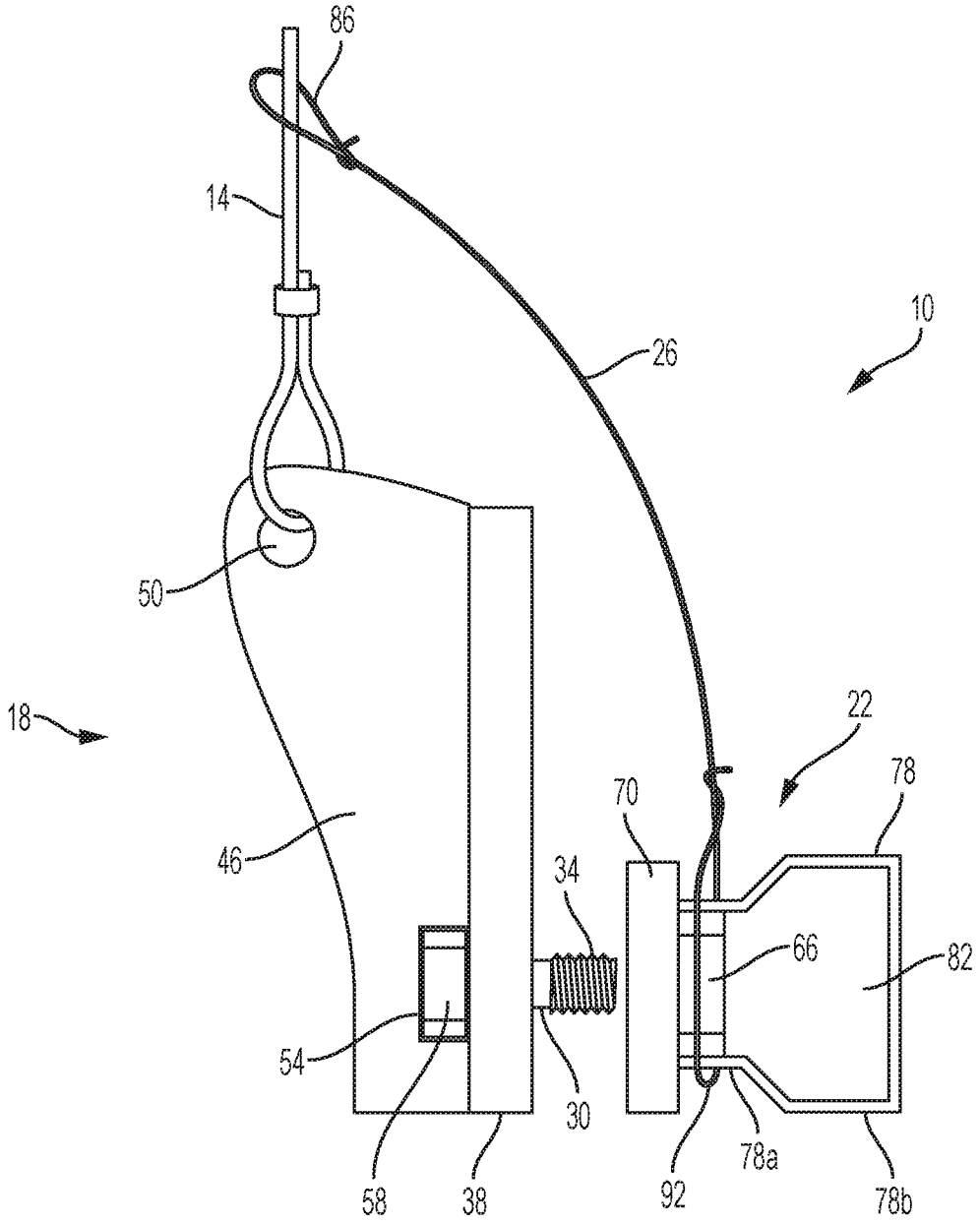
FIG. 2 shows a side view of an assembled lifting apparatus.

Turning now to FIG. 2, there is shown a side view of an assembled lifting apparatus 10, made in accordance with principles of the present invention. The bolt assembly 18 is suspended from the lifting cable 14 and is assembled so that the lifting eye 46 is attached to the base plate 38 so as to trap and hold the head 58 of the bolt 30.

Likewise, the nut assembly 22 is formed with the nut 66 being attached to the washer plate 70 and the handle 78. The wide handle 78 makes it easy for a construction worker and the like to manually screw the nut 66 onto the shaft of the bolt 34 once a steel sheet or the like is disposed on the bolt. Similarly, the nut assembly 22 may be conveniently removed manually by rotating the handle in the other direction. Additionally, the tether 26 is mounted to allow easy rotation of the handle 78, while still keeping the nut assembly 22 connected to the bolt assembly 18.

Figure 3:
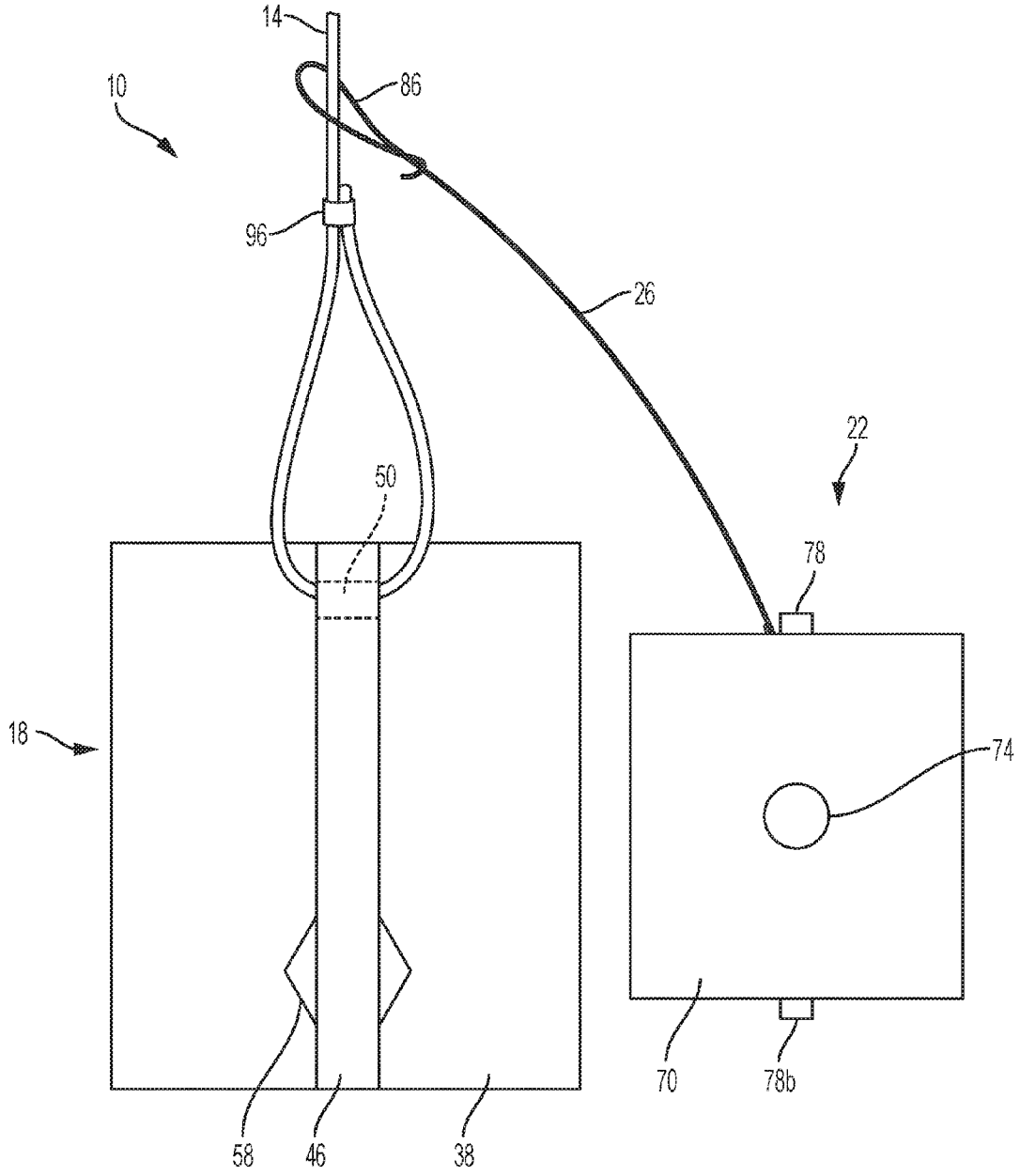
FIG. 3 shows a front view of the lifting apparatus of FIG. 2 with the bolt assembly and the nut assembly being off-set from one another.

Turning now to FIG. 3, there is shown a front view of the lifting apparatus 10 of FIG. 2 with the bolt assembly 18 and the nut assembly 22 being off-set from one another. The bolt assembly 18 shows the base plate 38 with the lifting eye 46 extending toward the viewer. The head 58 of the bolt may extend outwardly on each side of the lifting eye 46 or may be completely contained thereby. The lifting cable 14 is looped through the hole 50 of the lifting eye 46 and held with a clasp 96. The tether may loop around the lifting cable 14 or may pass through the hole 50 in the lifting eye.

FIG. 3 also shows the washer plate 70 of the nut assembly 22, along with the hole 74 formed therein. The second, broader portion 78*b* of the handle 78 is also visible—extending beyond the plate. The nut 66 and the loop 92 of the tether 26 are not visible in FIG. 3.

Figure 4:
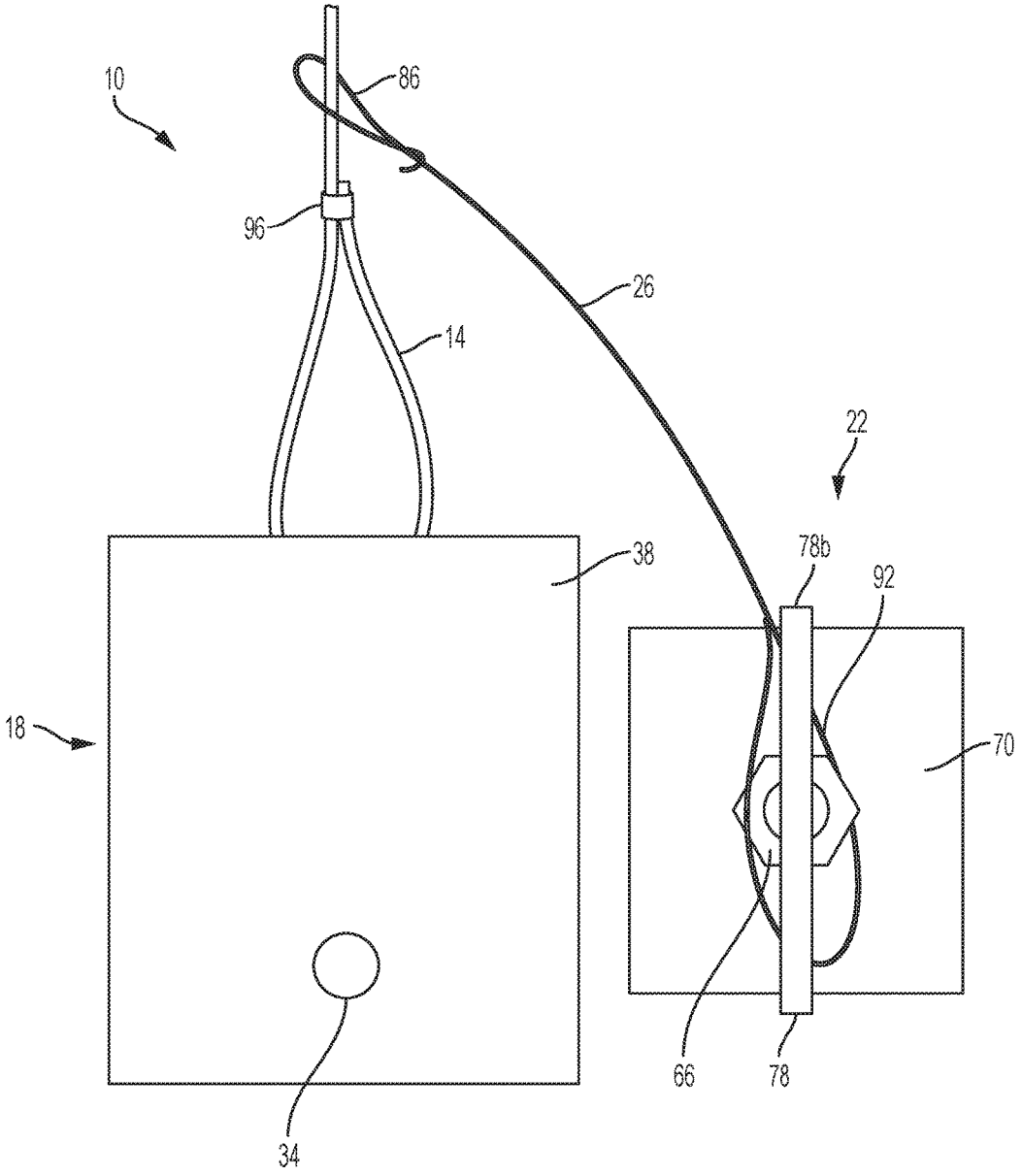
FIG. 4 shows a rear view of the lifting apparatus of FIG. 2 with the bolt assembly and the nut assembly off-set from one another.

FIG. 4 shows the lifting apparatus 10 from the opposite end as that shown in FIG. 3. The bolt assembly 18 includes the base plate 38 and the bolt shaft 34 which are both visible. The lifting eye 46 and the portion of the lifting cable 14 passing through the hole 50 in the lifting eye is not visible due to the support plate.

The nut assembly 22 on the other hand, shows the washer plate 70, the nut 66 and the handle 78. The loop 92 of the tether 26 loops around the first, narrower portion of the handle 78 so that the loop is held between the second, broader portion 78*b* and the washer plate 70 regardless of whether the handle is still or rotating.

Figure 5:
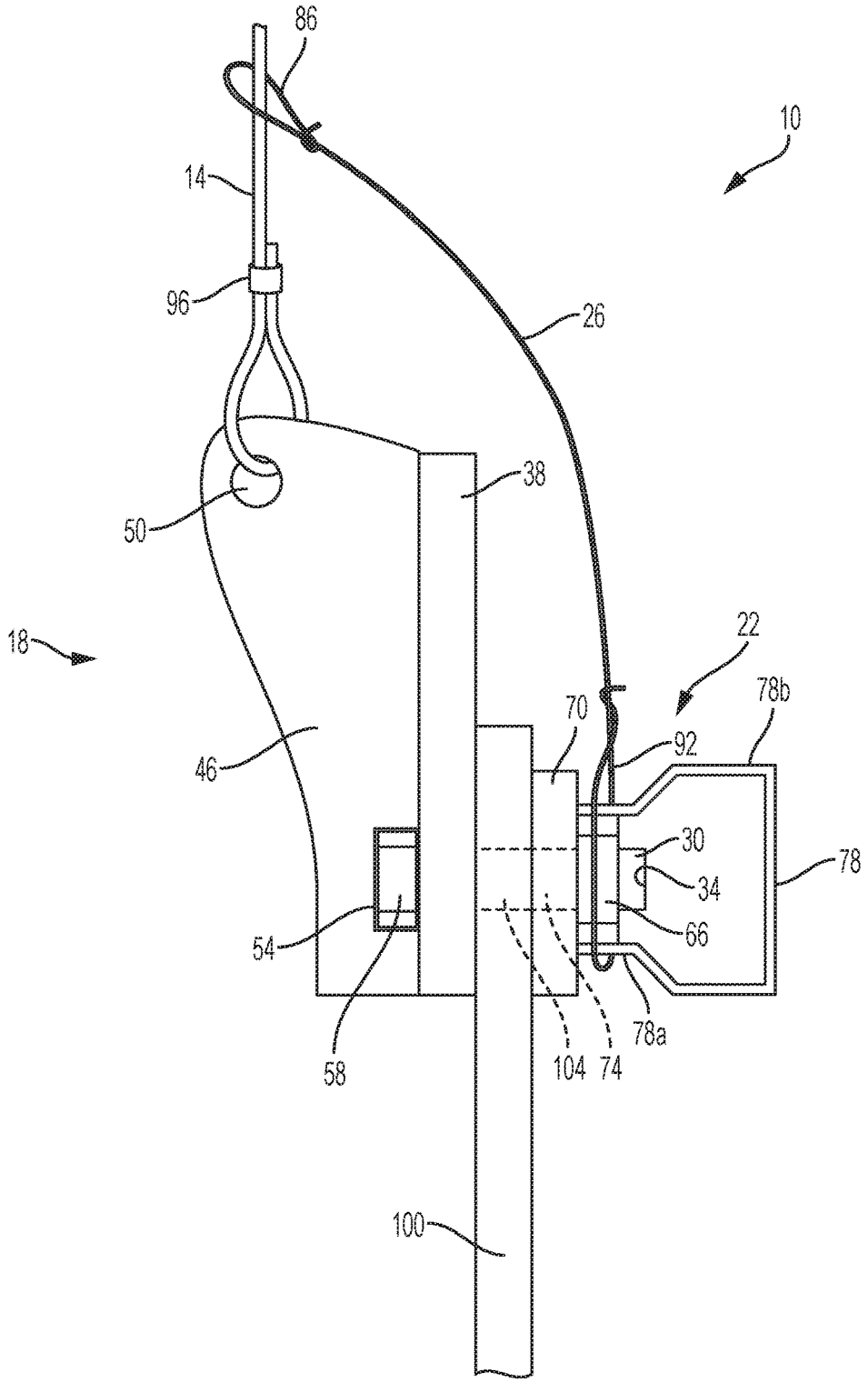
FIG. 5 shows a side view of the lifting apparatus lifting a steel plate.

Turning now to FIG. 5, there is shown a side view of the lifting apparatus 10 being used to lift a steel plate 100. The shaft 34 of the bolt 30 has been passed through a hole 104 in the steel plate 100 and then the nut assembly 22 has been tightened by rotating the handle 78 so that the shaft extends through the hole 74 in the washer plate 70 of the nut assembly, and through the nut 66. With the nut assembly 22 tightened, the sheet 100 (or multiple sheets) may be picked up and moved to a desired location. Once in place, the worker need only rotate the nut assembly counter-clockwise by rotating the handle in the opposite direction. The plate is then in place and lifting apparatus 10 can be moved to grab the next piece of steel, etc. Because of the tether 26, the nut assembly 22 does not get lost, as is common with other fasteners.

Figure 6:
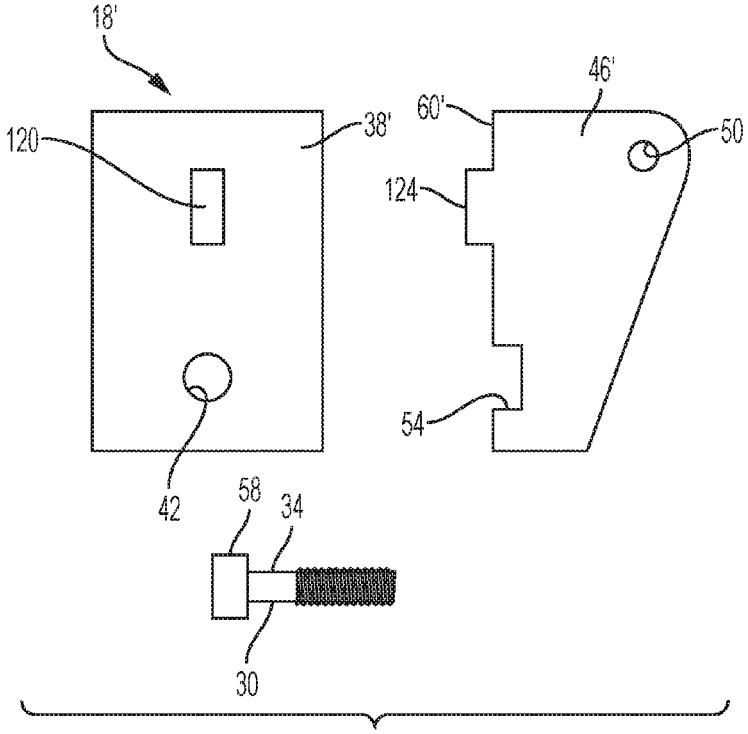
FIG. 6 shows an exploded view of an alternate configuration of the bolt assembly.

FIG. 6 shows an exploded view of an alternate configuration of the bolt assembly, generally indicated at 18'. The bolt assembly 18' includes a base plate 38'. While being shown as being generally rectangular, it will be appreciated that the support plate could be round, square or any other shape which will provide support to the bolt 30. The base plate 38' is similar to the base plate 38 discussed above in that it has a hole 42 for receiving the bolt 30. In addition to base plate 38, however, base plate 38' has a hole or channel 120 configured for receiving a port or arm 124 which extends from the bottom sidewall 60' of the lifting eye 46'.

The lifting eye 46' is likewise similar to the lifting eye 46 discussed above, with the exception that it includes the post or arm 124 extending from the bottom sidewall so as to nest in the hole or channel 120 in the base plate 38'. The engagement of the post or arm 124 in the hole or channel 120 provides two advantages. First, the engagement provides greater surface area along which the lifting eye 46' can be welded to the base plate 38'. In addition to receiving a weld along the bottom sidewall, an additional weld can be made along the bottom of the post or arm 124 and the sidewall of the base plate 38' which defines the hole or channel 120. Thus, a stronger attachment can be achieved.

The post or arm 124 may be cut so that it is shorter than the thickness of the base plate. This allows the use of a slot weld on the back side of the base plate 38', while keeping the face of the base plate flush. (It will be appreciated that the three components of the bolt assembly 18' can be welded together along their interfaces, as can be done with the nut assembly 22 as well).

Second, by having the post or arm 124 extend into the hole or channel 120, additionally rigidity is provided to the interface between the base plate 38' and the lifting eye 46'. In the prior embodiment, if a force perpendicular to the lifting eye is applied, all of the force must be held by the weld. In contrast, because the post or arm 124 extends into the hole or channel 120, the arm provides resistance to movement of the lifting eye independent of the welds.

FIG. 6 also shows the notch 54 being defined by a sidewall having a champhered area 54*a* near the opening of the notch. The champhered area 54 allows the notch to be closely received over the head 58 of the bolt 30 and the weld therearound. If the notch 54 is spaced sufficiently close, the plate forming the lifting eye 50 may also be welded to the bolt, further strengthening the bolt assembly.

Figure 7:
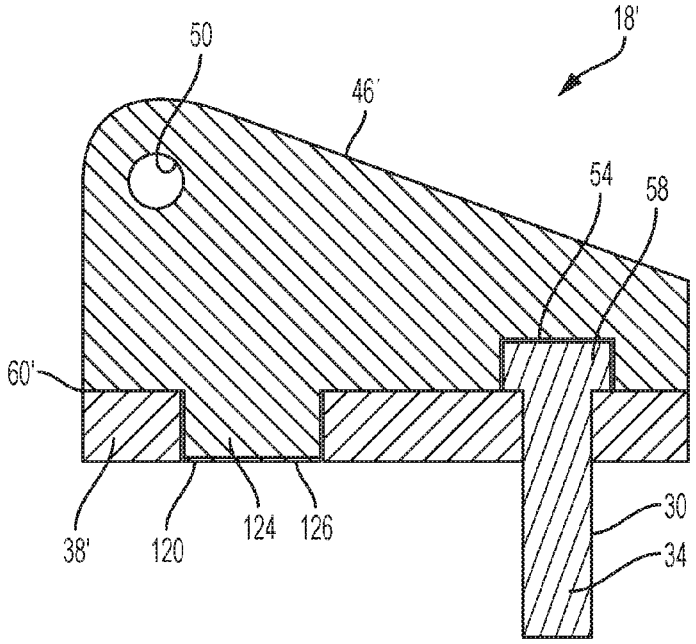
FIG. 7 shows a cross-sectional view of an assembled bolt assembly.

Turning now to FIG. 7, there is shown a cross-sectional view of the bolt assembly taken perpendicular to the base plate 38' and along the long axis of the lifting eye 46'. As discussed above, the lifting eye 46' includes a post or arm 124 which nests in a channel or hole 120 in the base plate 38' and secured therein with a slot weld 126. The lifting eye 46' and base plate 38' can be attached by a variety of mechanisms, although a presently preferred method is welding along at least the bottom sidewall 60 of the lifting eye. A weld may also be placed along the post or arm 124 and the opposing side of the base plate 38'.

With the lifting eye 46' secured in place, the bolt 30 is held firmly within the bolt assembly 18'. The lifting eye 46' can be used to secure the bolt 30 in place, or the bolt can be welded to the base plate 38' and/or the lifting eye, typically along the head 58 of the bolt.

While the present invention shows two embodiments of the bolt assembly and the nut assembly, it will be appreciated in light of the present disclosure that other configurations may be used in accordance with principle of the present invention. For example, either the bolt assembly or the nut assembly made be made from fewer or more parts, or may be made integrally. For example, the nut and the handle could be formed from a single piece of material, as could the handle and the support plate. Likewise, the bolt and support plate could be made from a single piece of material, as could bolt and the lifting eye or the support plate and the lifting eye. Thus it should be appreciated that the appended claims are not limited by the specific embodiments discussed herein.

It will be appreciated that the present disclosure covers multiple inventions which may be used together or separately. For example a lift apparatus may include: a bolt assembly; and a nut assembly having a nut and a handle connected to the nut. The lift apparatus may further include one or more of: the bolt having a head and the lifting eye having a notch which fits over the head of the bolt to hold the head of the bolt between the lifting eye and the support plate; the nut assembly further having a support plate and at least one of the nut and the handle being attached to the support plate; a tether for connecting the nut assembly to the bolt assembly; the tether having a loop which encircles the handle; the nut being attached to a support plate and wherein the support plate and the handle extend radially outward beyond the nut so that a portion of the tether is held between the support plate and the handle; the bolt assembly having a support plate having a hole therein and a bolt extending through the hole in the support plate; the bolt being welded to the plate; the bolt assembly having a lifting eye configured for attachment to a lifting cable; the bolt having a head and wherein the lifting eye comprises a notch which fits over the head of the bolt to hold the head of the bolt between the lifting eye and the support plate; the lifting eye having an arm and wherein the support plate comprises a channel and wherein the arm of the lifting eye nests in the channel of the support plate; the lifting eye being welded to the support plate; and/or the bolt assembly having lifting cable attached thereto and further comprising a tether which is disposed about the lifting cable at one end and about the handle of the nut assembly at an opposing end, or combinations thereof.

The present invention may include a method of lifting a piece of material, the method comprising: selecting a bolt assembly having a bolt having a shaft and a nut assembly having a nut, and a tether connecting the bolt assembly and the nut assembly; and positioning a piece of material on the shaft of the bolt and screwing the nut onto the bolt while the nut assembly and bolt assembly remain connected by the tether. The method may further include: the bolt assembly having a lifting eye attached to a lifting cable and wherein the tether is attached to at least one of the lifting cable and the lifting eye; and/or the nut assembly having a handle connected to the nut such that rotation of the handle rotates the nut and wherein the method comprises rotating the handle while the tether is disposed about the handle.

The present invention may also include: A lifting apparatus having a bolt assembly including a bolt and a lifting eye connected to the bolt; and a nut assembly comprising a nut and a handle, the handle being connected to the nut such that rotation of the handle rotates the nut. The lifting apparatus may further include: the bolt assembly having a support plate, the lifting eye being attached to the support plate and holding a portion of the bolt between the support plate and the lifting eye; the nut and the lifting eye being welded to the support plate; the nut assemble having a support plate and wherein the nut and the handle are welded to the support plate; the handle having a first, narrow portion adjacent the nut and a second, broader portion disposed away from the nut; the bolt assembly and the nut assembly being connected by a tether; and/or the tether being movably attached to the bolt assembly and moveably attached to the handle, and combinations thereof.

Figure 8:
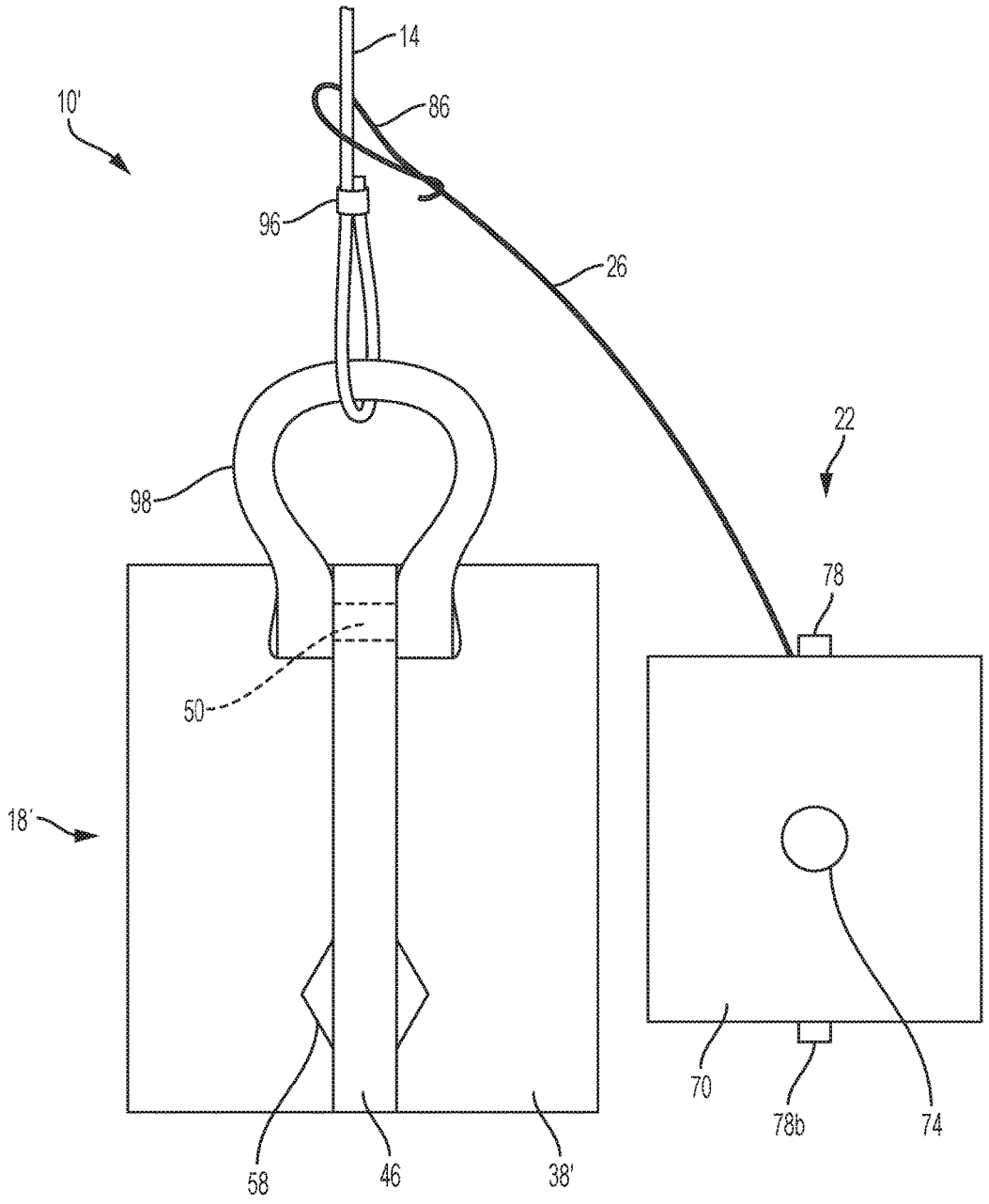
FIG. 8 shows the bolt assembly and nut assembly of attached to a lift cable by a shackle.

Turning now to FIG. 8, there is shown a lifting apparatus 10 similar to that shown in FIGS. 1-7 above. Rather than the lifting cable 14 extending through the hole 50 in the lifting eye 46, however, the lifting cable 14 is attached to a shackle 98, which, in turn is attached to the lifting eye 46 via a bolt, etc. The use of the shackle 98 allows the bolt assembly 18 and the nut assembly 22 to pivot with respect to the lifting cable more easily. This helps the suspended sheet, etc., hang more vertically during movement. It has been found in testing such configurations that the lifting cable is always the first component to fail. Thus, the device can be used with very heavy objects based on the strength of the lifting cable.

It will be appreciated that the present disclosure includes multiple inventive concepts. For example, a lift apparatus may include a bolt assembly and a nut assembly comprising a nut and a handle connected to the nut. It may further include: the nut assembly further having a washer plate and at least one of the nut and the handle being attached to the support plate; a tether for connecting the nut assembly to the bolt assembly; a tether having a loop which encircles the handle; the nut being attached to the washer plate and the support plate and the handle extending radially outward beyond the nut so that a portion of the tether is held between the washer plate and the handle; the bolt assembly having a base plate with a hole therein and a bolt extending through the hole in the base plate; the bolt being welded to the base plate; the bolt assembly having a lifting eye configured for attachment to a lifting cable; the bolt having a head and the lifting eye having a notch which fits over the head of the bolt to hold the head of the bolt between the lifting eye and the base plate; the lifting eye having an arm and the base plate having a channel and the arm of the lifting eye nesting in the channel of the base plate; the lifting eye being welded to the base plate; and/or the bolt assembly having a lifting cable attached thereto and further including a tether which is disposed about the lifting cable adjacent one end and about the handle of the nut assembly adjacent an opposing end, and combinations thereof.

The present disclosure also teaches method for lifting material, including, for example, selecting a bolt assembly having a bolt having a shaft and a nut assembly having a nut, and a tether connecting the bolt assembly and the nut assembly, and positioning a piece of material on the shaft of the bolt and screwing the nut onto the bolt while the nut assembly and the bolt assembly remain connected by the tether. The method may also include the bolt assembly having a lifting eye attached to a lifting cable and the tether being to at least one of the lifting cable and the lifting eye; and/or the nut assembly having a handle connected to the nut such that rotation of the handle rotates the nut and wherein the method further includes rotating the handle while the tether is disposed about the handle.

The present disclosure also teaches a lifting apparatus which may include: a bolt assembly including a bolt and a lifting eye connected to the bolt and a nut assembly comprising a nut and a handle, the handle being connected to the nut such that rotation of the handle rotates the nut. The assembly may further include: the bolt assembly having a base plate, the lifting eye being attached to the base plate and holding a portion of the bolt between the base plate and the lifting eye; the bolt and the lifting eye being welded to a base plate; the nut assembly having a washer plate and wherein the nut and the handle are welded to the washer plate; the handle including a first, narrow portion adjacent the nut and a second, broader portion disposed away from the nut; the bolt assembly and the nut assembly being connected by a tether; and/or the tether being movably attached to the bolt assembly and moveably attached to the handle, and combinations thereof.

Thus there is disclosed an improved lifting apparatus. Those of skill in the art will appreciate that numerous modifications may be made hereto without departing from the scope and spirit of the invention. The appended claims are intended to cover such modifications.

What is claimed is:

1. A method of lifting a piece of material, the method comprising:

selecting a bolt assembly having a bolt having a shaft and a nut assembly having a nut, and a tether having a first end and a second end, the first end of the tether attached to the bolt assembly and the second end of the tether attached to the nut assembly;

positioning the piece of material on the shaft of the bolt and screwing the nut onto the bolt while the nut assembly remains attached to the second end of the tether and the bolt assembly remains attached to the first end of the tether.

2. The method according to claim 1, wherein the bolt assembly comprises a base plate and a lifting eye attached to a lifting cable, and wherein the first end of the tether is attached to at least one of the lifting cable and the lifting eye.

3. The method of claim 2, wherein the lifting eye comprises an arm and wherein the base plate comprises a channel and wherein the arm of the lifting eye nests in the channel of the base plate.

4. The method according to claim 1, wherein the nut assembly comprises a handle connected to the nut such that rotation of the handle rotates the nut and wherein the method further comprises rotating the handle while the second end of the tether is disposed about the handle.

5. The method according to claim 4, wherein the step of selecting a bolt assembly comprises selecting a bolt assembly having a base plate.

6. The method according to claim 5, wherein the step of selecting a nut assembly comprises selecting a nut assembly having a washer plate.

7. The method according to claim 6, wherein the step of positioning the piece of material on the shaft of the bolt comprises positioning the piece of material between the base plate and the washer plate.

8. The method of claim 6, wherein the step of selecting a nut assembly comprises selecting a nut assembly wherein at least one of the nut and the handle are attached to the washer plate.

9. A method of lifting a piece of material, the method comprising:

selecting a lifting apparatus, the lifting apparatus comprising:

a bolt assembly including a bolt, a base plate, and a lifting eye connected to the bolt, wherein the lifting eye comprises a sidewall defining a notch to receive a head of the bolt, the head of the bolt being held within the notch and between the lifting eye and the base plate; and a nut assembly comprising a nut and a handle;

passing the bolt through the piece of material; and connecting the nut assembly to the bolt.

10. The method according to claim 9, the handle being connected to the nut such that rotation of the handle rotates the nut, and wherein the step of connecting the nut assembly to the bolt further comprises rotating the nut by rotating the handle.

11. The method according to claim 9, wherein the step of connecting the nut assembly to the bolt further comprises threadably connecting the nut assembly to the bolt.

12. The method according to claim 9, further comprising selecting a tether for holding the nut assembly in connection to the bolt assembly.

13. The method according to claim 12, wherein the handle comprises a first, narrow portion adjacent the nut and a second, broader portion disposed away from the nut.

14. The method according to claim 13, wherein the step of selecting a tether for holding the nut assembly in connection to the bolt assembly comprises selecting a tether having a loop sized to fit around the narrow portion of the handle, the loop being sufficiently small to resist passage of the broad portion of the handle through the loop.

15. The method according to claim 9, wherein the nut assembly comprises a washer plate.

16. The method according to claim 15, further comprising the step of positioning the piece of material between the base plate and the washer plate.

17. The method of claim 15, wherein at least one of the nut and the handle are attached to the washer plate.

18. A method for lifting a piece of steel plate having a hole therethrough, the method comprising:

selecting a lift apparatus comprising:

a bolt assembly, wherein the bolt assembly comprises a lifting eye configured for attachment to a lifting cable, a bolt attached to the lifting eye, the bolt having a shaft, and a base plate;

a nut assembly comprising a nut configured for threaded attachment to the bolt assembly, the nut having a handle connected to the nut, the handle comprising a narrow portion adjacent to the nut and a broad portion extending distally to the nut, the nut assembly further comprising a washer plate; and a tether for holding the nut assembly in connection to the bolt assembly, the tether having a first end for connection to the bolt assembly and a second end for connection to the nut assembly, the second end of the tether having a loop sized to fit around the narrow portion of the handle, the loop being sufficiently small to resist passage of the broad portion of the handle through the loop;

connecting the piece of steel plate to the lift apparatus, wherein the step of connecting the piece of steel plate to the lift apparatus comprises positioning the piece of steel plate on the shaft of the bolt between the base plate and the washer plate.

19. The method according to claim 18, wherein the loop of the second end of the tether is smaller in diameter than a length and width of the washer plate such that the loop is held between the washer plate and the broad portion of the handle.

* * * * *